US005655952A

United States Patent [19]

Schunn et al.

[11] Patent Number: 5,655,952

[45] Date of Patent: Aug. 12, 1997

[54] SYSTEM FOR HONING CAMSHAFT CAMS

[75] Inventors: Ingo Schunn; Peter Weiss; Martin Wolters, all of Wuppertal, Germany

[73] Assignee: Ernst Thielenhaus KG, Wuppertal, Germany

[21] Appl. No.: 495,233

[22] Filed: Jun. 26, 1995

Related U.S. Application Data

[63] Continuation-in-part of Ser. No. 93,493, Jul. 16, 1993, abandoned.

[30] Foreign Application Priority Data

Jul. 31, 1992 [DE] Germany ..... 42 25 259.8
Jul. 31, 1992 [DE] Germany ..... 42 25 260.1

[51] Int. Cl.[6] ..... B24B 1/00

[52] U.S. Cl. ..... 451/62; 451/173

[58] Field of Search ..... 451/62, 164, 173

[56] References Cited

U.S. PATENT DOCUMENTS 3,369,329 2/1968 Beiman .

FOREIGN PATENT DOCUMENTS 3011455 8/1982 Germany .
3011454 4/1984 Germany .
3841976 1/1990 Germany .

*Primary Examiner*—Joseph M. Gorski
*Attorney, Agent, or Firm*—Herbert Dubno; Andrew Wilford

[57] ABSTRACT

An outer surface of a cam on a camshaft extending along a camshaft axis is honed by continuously rotating the camshaft about its axis while holding a grinding stone adjacent the cam with a surface of the stone directed radially inward at the cam surface. Movement of the grinding stone is restricted to displacement in two directions, one direction extending substantially radially of the camshaft axis and the other direction extending generally perpendicular to the one direction. The grinding stone is urged in the one direction extending radially of the axis against the stone to press the cam surface radially inward against the cam surface for contact of the stone surface along a line with the cam surface so that the stone moves in a radial direction as the camshaft rotates. The stone surface is continuously reciprocated in the other direction generally parallel to a plane perpendicular to the radial direction so as to continuously move the contact line between the cam and stone surfaces.

7 Claims, 9 Drawing Sheets

FIG. 9
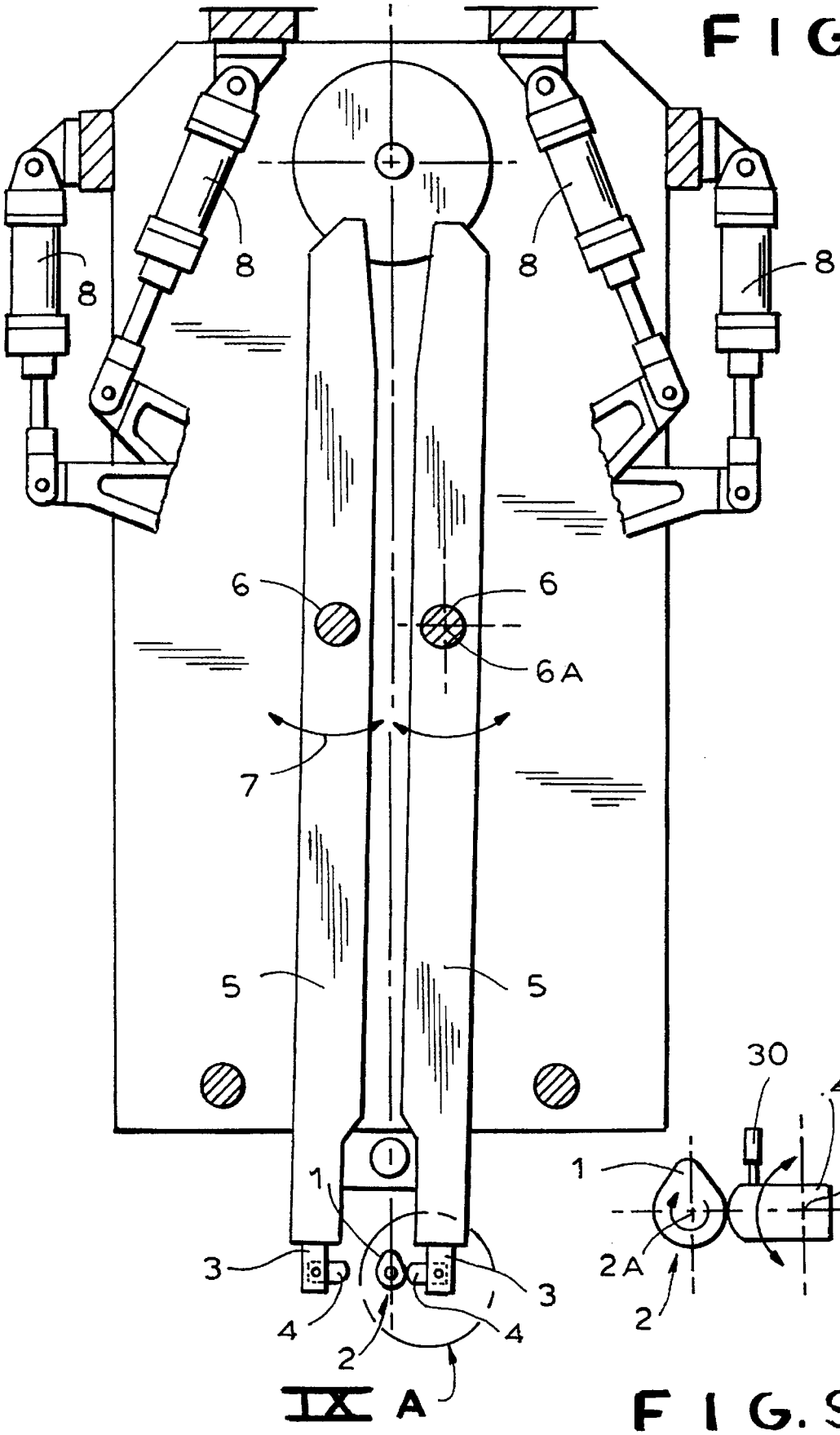
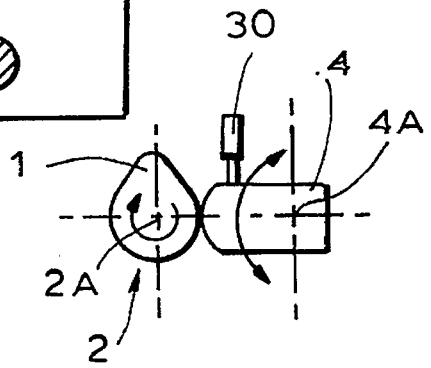
FIG. 9A

SYSTEM FOR HONING CAMSHAFT CAMS

SPECIFICATION

CROSS REFERENCE TO RELATED APPLICATION

This application is a continuation-in-part of application Ser. No. 08/093,493 filed 16 Jul. 1993, and now abandoned.

FIELD OF THE INVENTION

The present invention relates to a system for honing the cams of a camshaft. More particularly this invention concerns a method of fine-finishing the lobular cams of a motor-vehicle cams haft.

BACKGROUND OF THE INVENTION

A cam on a camshaft has an outer surface which is normally formed by a part-cylindrical base region that is coaxial with the camshaft and with a lobe region that is eccentric to this axis. These regions must be machined to very tight tolerances, with the last operation being a honing of the surfaces to a near mirror finish, as in use in a motor vehicle the camshaft rotates at high speed while cam followers ride on the cam surfaces.

The honing operation as described in *Lueger Lexikon der Technik* (Deutsche Verlags, Stuttgart, volume 8 at pages 442 and 443) is carried out by urging fine-grit honing stones radially against the cams as the shaft is rotated about its axis. The stones have surfaces engaging the respective cams and each formed as a family of parallel lines parallel to the camshaft axis. These stones may also be reciprocated axially somewhat during the honing operation.

As described in German patents 3,011,454, 3,011,455, and 3,841,916 two stones are mounted in respective holders on the ends of respective arms at each cam, and these stones are diametrically opposed to each other to prevent the camshaft from being bowed. At the start of the grinding operation each stone surfaces is convex radially toward the camshaft so that it engages the respective cam surface along a contact line extending parallel to the camshaft axis. As the cam is rotated this contact line migrates somewhat on the stone surface as the stone surface engages the lobe region of the cam, but while the stone surface is engaged against the cylindrical base region it does not move at all. Thus in short order the stone wears away at the line where it spends most of its time in contact with the base region and takes on a shape concave toward the camshaft with a part-cylindrical recess on its face of the same diameter as the base region of the cam.

As a result the initially convex face of the grinding stone, engages the workpiece in line contact and therefore has good material-removal characteristics, becomes a concave face that the workpiece in surface contact, with greatly reduced grinding efficiency.

is known from the lens-grinding art, for instance from U.S. Pat. No. 3,369,329 of Beiman, to pivot a hard tool about an axis corresponding to the center of curvature of its effective surface displacing a soft workpiece past it in a transverse direction. In such a system, however, the goal is to produce a rounded finish on the workpiece as there is no perceptible wear to the tool itself is much harder than the workpiece.

OBJECTS OF THE INVENTION is therefore an object of the present invention to provide an grinding system for a camshaft.

Another object is the provision of such an improved grinding system for a camshaft which overcomes the above-given disadvantages, that is which retains the grinding efficiency of a new stone, after substantial use of the stone.

SUMMARY OF THE INVENTION

An outer surface of a cam on a camshaft extending along a camshaft axis is honed by continuously rotating the camshaft about its axis while holding a grinding stone adjacent the cam with a surface of the stone directed radially inward at the cam surface. According to the invention movement of the grinding stone is restricted to displacement in two directions, one direction extending substantially radially of the camshaft axis and the other direction extending generally perpendicular to the one direction. The grinding stone is urged in the one direction extending radially of the axis against the stone to press the cam surface radially inward against the cam surface for contact of the stone surface along a line with the cam surface so that the stone moves in a radial direction as the camshaft rotates. The stone surface is continuously reciprocated in the other direction generally parallel to a plane perpendicular to the radial direction so as to continuously move the contact line between the cam and stone surfaces.

Thus the contact line between the stone and the cam will move continuously, so that wear will not be concentrated in one location and the stone will not wear to fit in surface contact on the cam. The cam surface includes a part-cylindrical base region coaxial with the camshaft and a lobe region projecting radially outward from and joined to the base region. The stone surface is continuously displaced while engaging both of the regions. The stone therefore stays sharp.

According to this invention the stone surface is cylindrical and centered on a stone axis. The stone surface is displaced by rotating the stone about the stone axis. More particularly, the stone surface is rotated at a rate which is smaller by at least 20% than a rotation rate of the camshaft about its axis. More particularly the rotation rate of the stone is some 20% to 60% smaller than the camshaft rotation rate. The stone surface is rotated in the same direction as the camshaft.

In accordance with another feature of this invention the stone is pivotal about a stone axis offset from the camshaft axis and from the stone surface. The stone surface is displaced by oscillating the stone about the stone axis. It is possible also for the stone surface to be displaced by reciprocating the stone tangentially of the cam surface. When the base region has a predetermined radius, the stone surface is displaced by reciprocating displacement through a stroke having a length generally equal to the radius. Alternately when the camshaft is rotated at a rate, the stone surface is displaced by being reciprocated at a rate that is not equal to a whole-number multiple of the shaft revolution rate, or conversely the stone surface is displaced by being reciprocated at a rate and the camshaft is rotated at a rate that is not equal to a whole-number multiple of the shaft revolution rate. Thus the one rate is never a whole-number multiple tiple of the other, in other words the frequencies are never resonant.

Normally the camshaft has a plurality of such cams spaced axially apart and two such stones are urged oppositely diametrically against each cam. The stone surfaces are displaced by being reciprocated oppositely to each other.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing:

FIGS. 6, 7, 8, and 9 are partly diagrammatic end views illustrating various apparatuses for carrying out the inventive method; and FIGS 8A and 9A are large-scale views of the details indicated at VIIIA and IXA of respective FIGS. 8 and 9.

SPECIFIC DESCRIPTION

Figure 1:
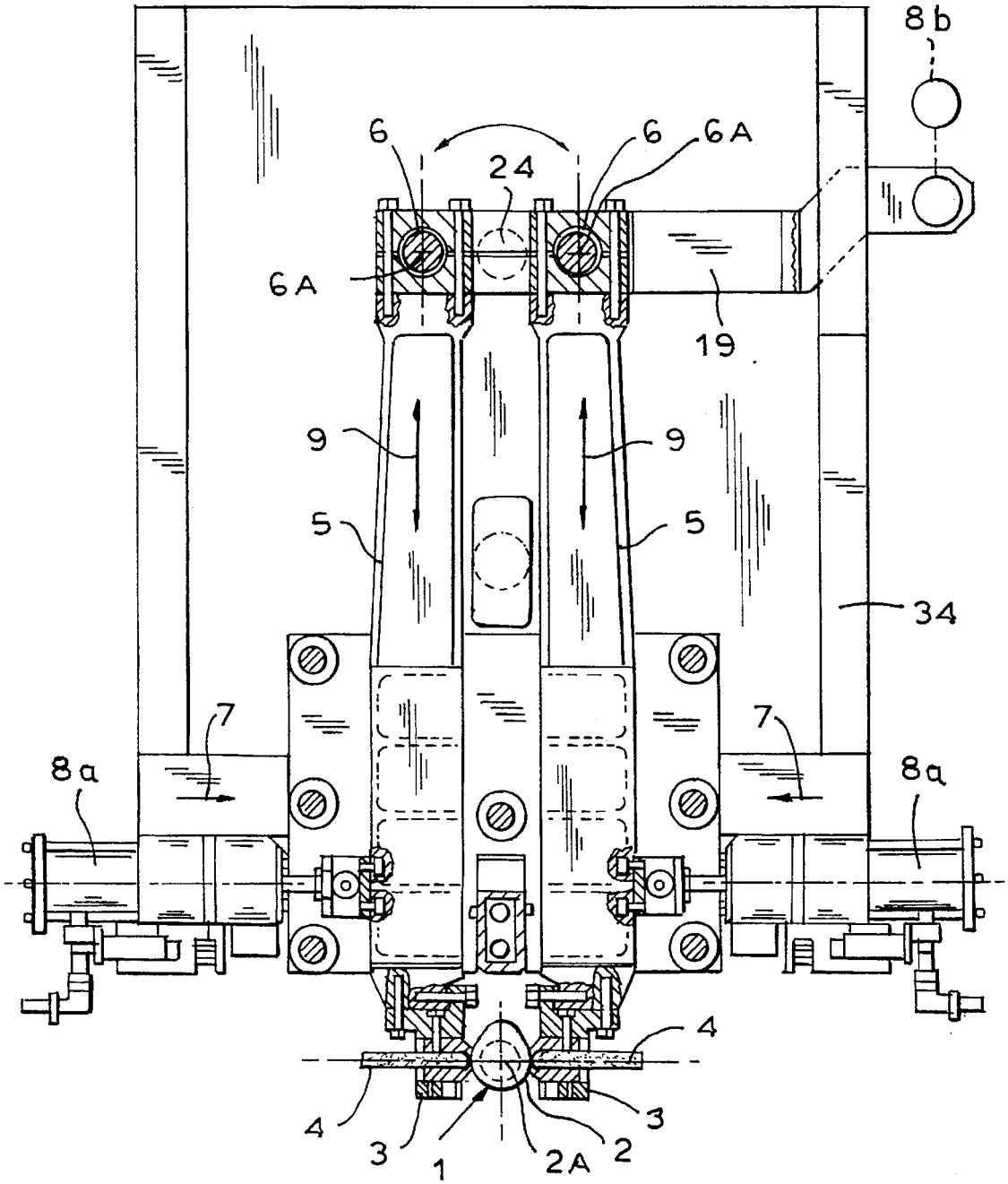
FIG. 1 is a simplified and partly schematic end view of the honing system of this invention.
Figure 1A:
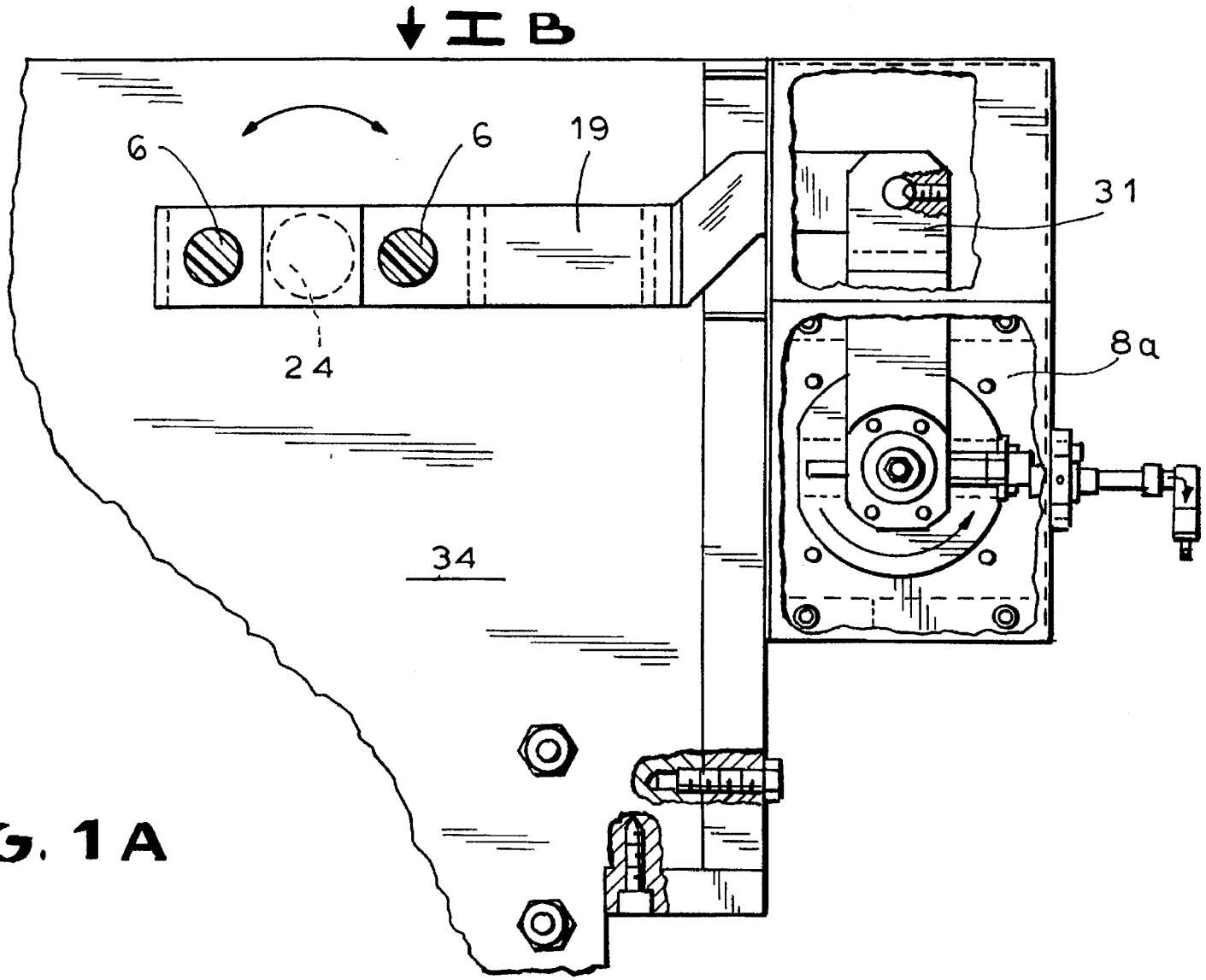
FIG. 1A is a view of a detail of FIG. 1.
Figure 1B:
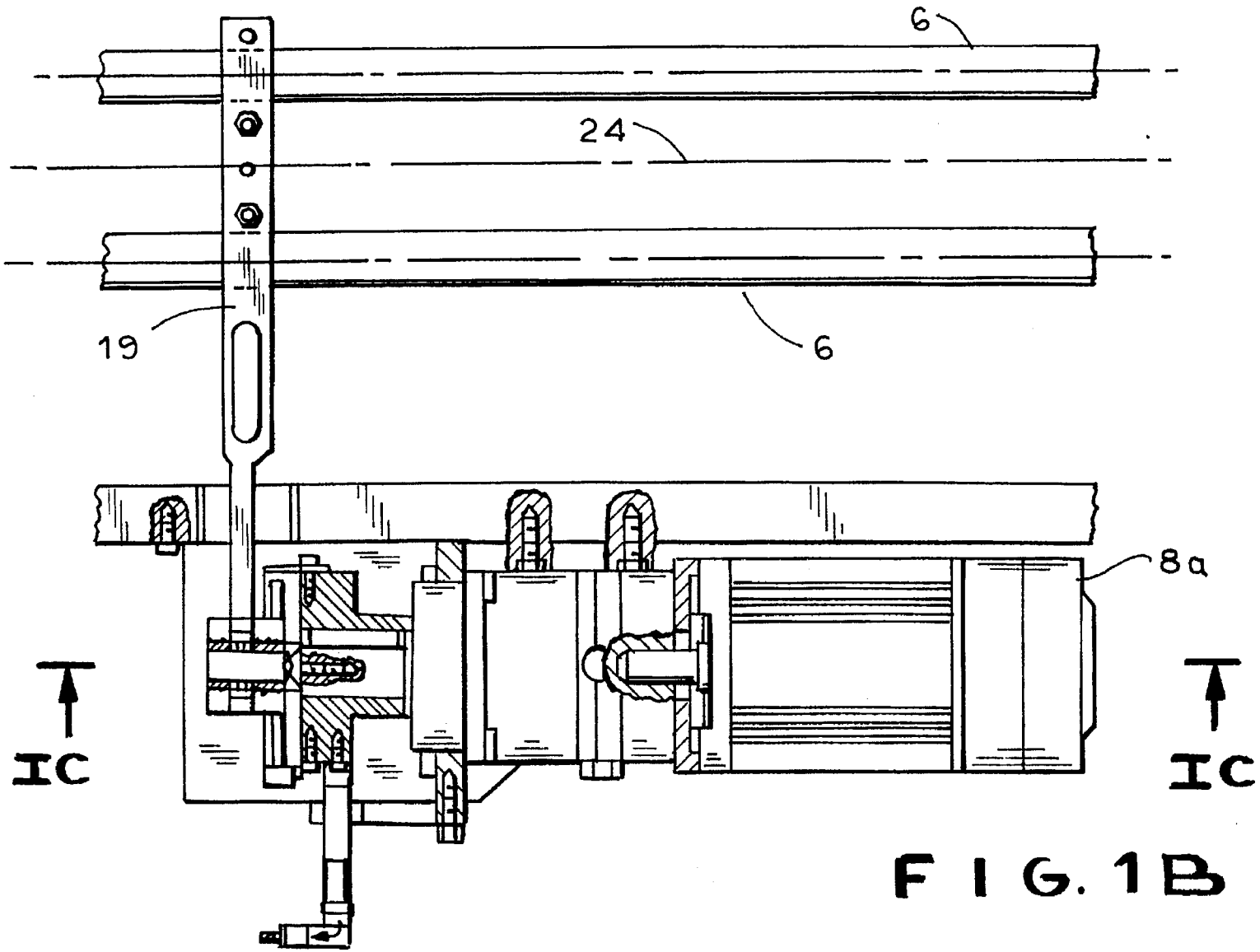
FIG. 1B is a top view taken in the direction of arrow IB of FIG. A.
Figure 1C:
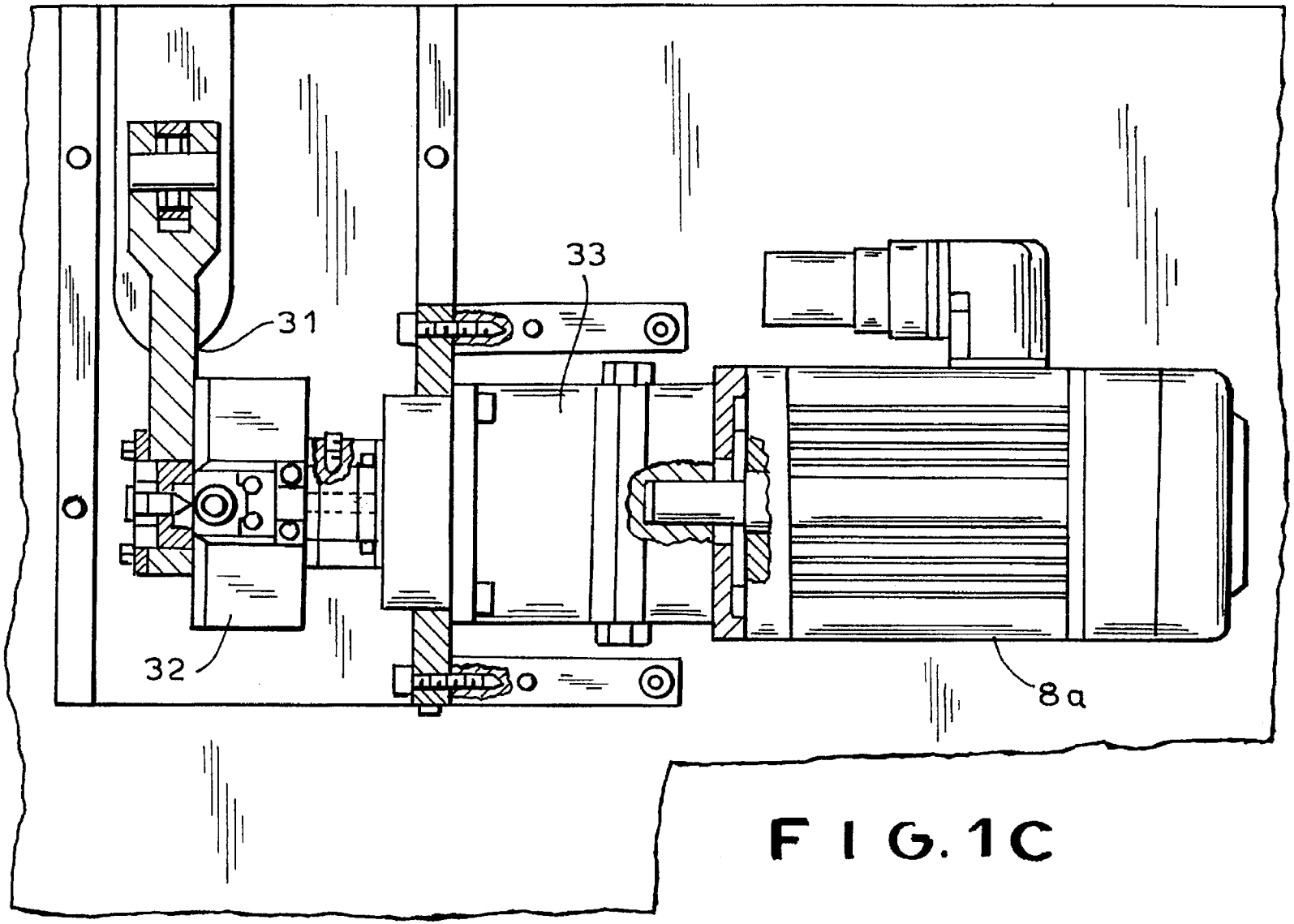
FIG. 1C is a vertical section taken along line IC—IC of FIG. 1B.

As seen in FIGS. 1, 1A, 1B, and 1C a camshaft 2 extending along a normally horizontal axis 2A carries a plurality of cams 2 that are each engaged radially by a pair of stones 4 carried in holders 3 mounted on the lower ends of respective arms 5 in turn carried on pivotal shafts 6 having axes 6A parallel to the axis 2A. Actuators 8*a* connected to the arms 5 urge the stones 4 radially against opposite sides of the cams 1 as indicated by arrows 7 and a further actuator 8*b* can vertically reciprocate the shafts 6 as illustrated by arrows 9. The two shafts 6 are journaled in an arm 19 pivoted centrally between the shafts 6 on an axle 24. An outer end of the arm 19 is connected via a link 31 to eccentric drive 32 operated by a transmission 33 from a motor 3*a* fixed on a housing 34 of the machine. Thus the stones 4 car only move radially of the axis 2A and substantially parallel to a vertical plane P through this axis 2A; they are constrained against any other movement, for instance axial.

Figure 2:
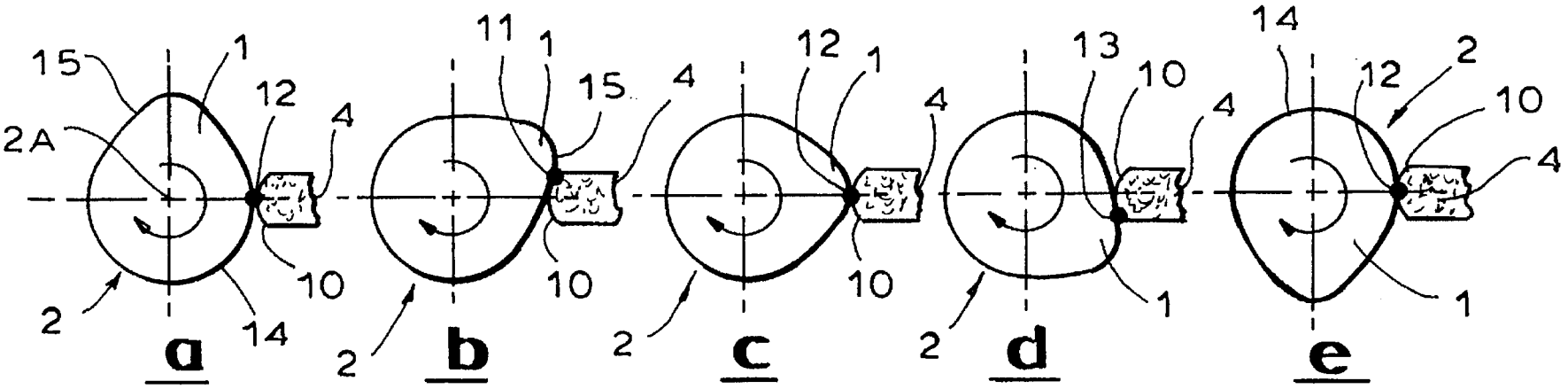
FIG. 2 PRIOR ART
FIG. 2 shows at a through e five stages of grinding in a prior-art system.
Figure 3:
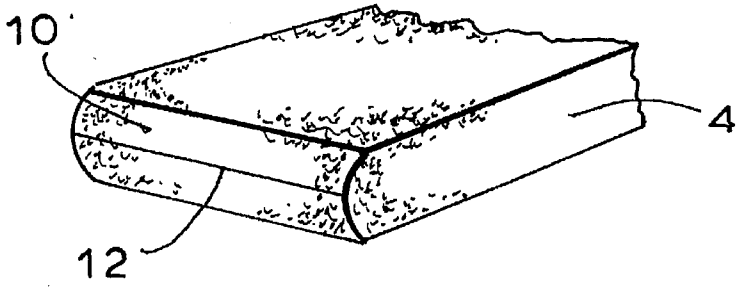
FIG. 3 is a large-scale perspective view of a grinding stone according to the invention.

In the prior art as seen in FIG. 2 the stone 4 has a surface 10 rides on a part cylindrical base region 14 or a noncylindrical lobe region 15 of the cam 1. To start with as shown at a surface 12 engages the surface 14 at a centerline 12 parallel to the axis 2A. As it rides up on the lobe region 15 the contact line 11 is moved upward as shown at b, then migrates back to the center as seen at c, and downward to line 13 as shown at d. Once the lobe region 15 is passed contact is again at the center at as seen at e. Since the base region 14 extends over somewhat than 180°, wear will be concentrated in the center region at line 12, resulting in short order in the formation of a part-cylindrical concavity in this region. For most efficient grinding (see FIG. 3), line contact is preferred, as line contact gives results than surface contact.

Figure 4:
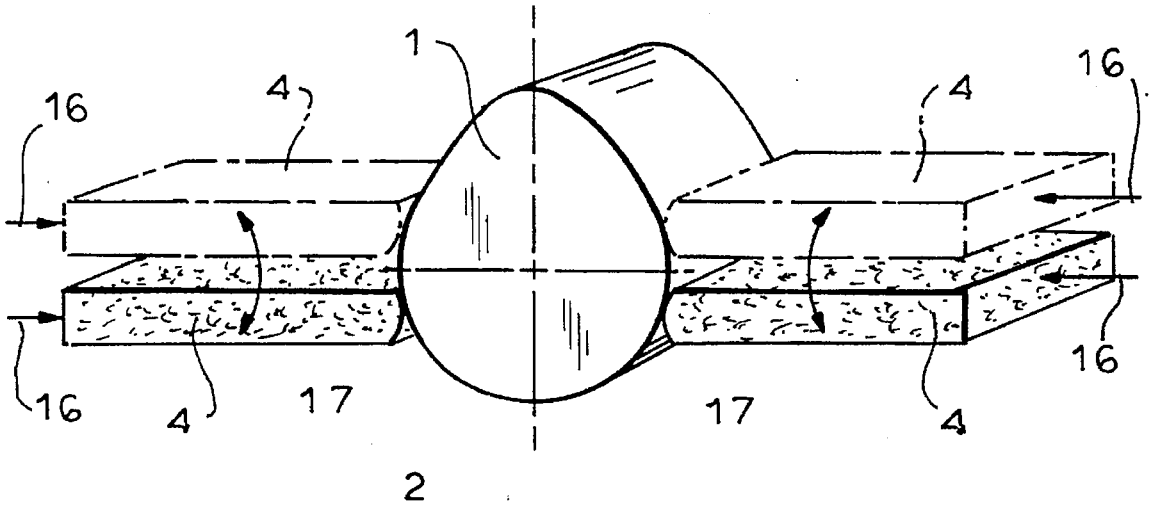
FIG. 4 is a large-scale perspective view schematically illustrating a method of this invention.
Figure 5:
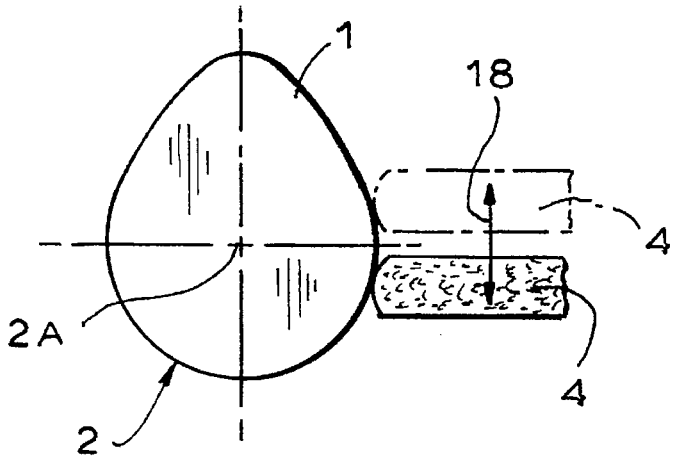
FIG. 5 is a large-scale end view illustrating a variant on the method of this invention.

According to the invention such line contact is maintained, and at one location is prevented, by moving the contact between the stone surface 10 and the cam surface 14, 15 even the stone 4 is engaging the cylindrical surface region 14. This can be done as seen in FIG. 4 by oscillatingly pivoting stones 4 about axes parallel to but relative far from the axis 2A to create arcuate movement as indicated by arrows 17 in FIG. 4, while the stones 4 are urged inward as indicate by arrows 16. Alternately as illustrated in FIG. 5, which is the system of FIG. 1, the stones 4 are each moved in a straight line as indicated at 18 in a direction parallel to a plane (here vertical) including the axis 2A.

Figure 6:
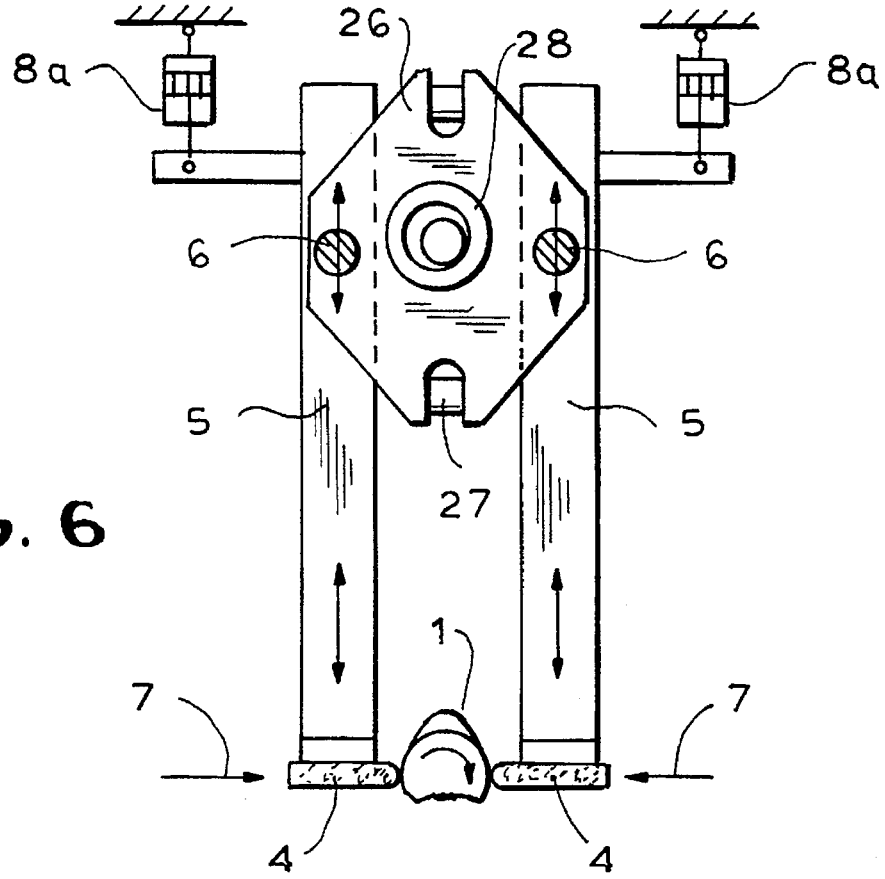

In FIG. 6 the two shafts 6 are mounted in a slide 26 vertically displaceable on guides 27 and centrally engaged by a continuously rotating eccentric 28. Thus the two stones 4 will move synchronously up and down.

Figure 7:
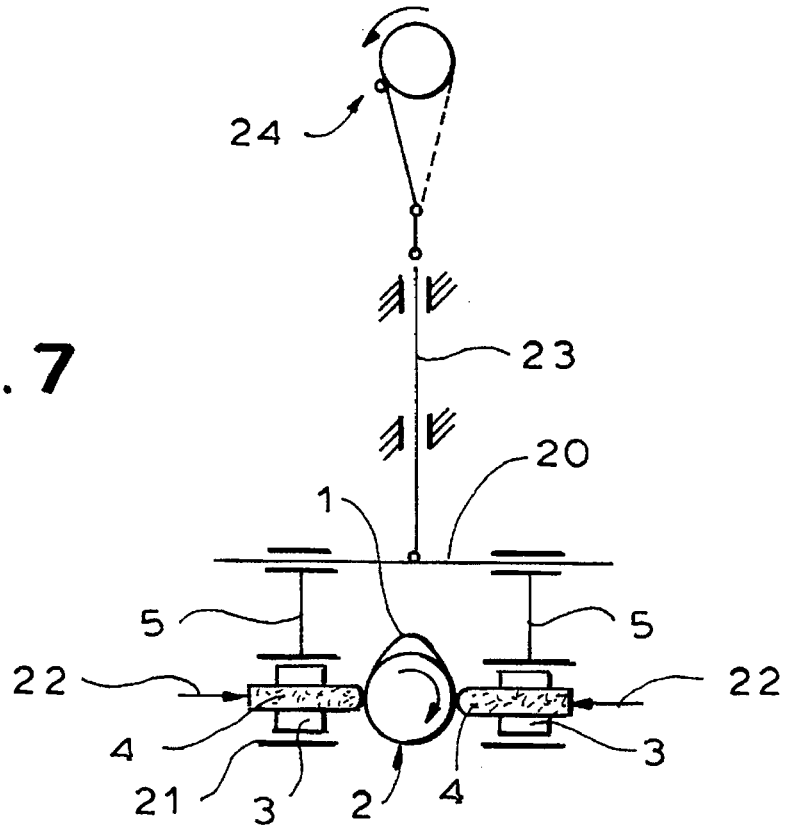

FIG. 7 shows an arrangement where the holders 3 are only horizontally displaceable in horizontal and radially extending guides 1 and are urged radially inward as indicated by respective arrows 22. The guides 21 are carried on the lower ends of the arms 5 which are horizontally slidably mounted at their upper ends on a traverse 20 connected via a rod 23 to a crank drive 24. Thus the stones 4 here will be reciprocated identically to those of FIG. 6.

Figures 8, 8A:
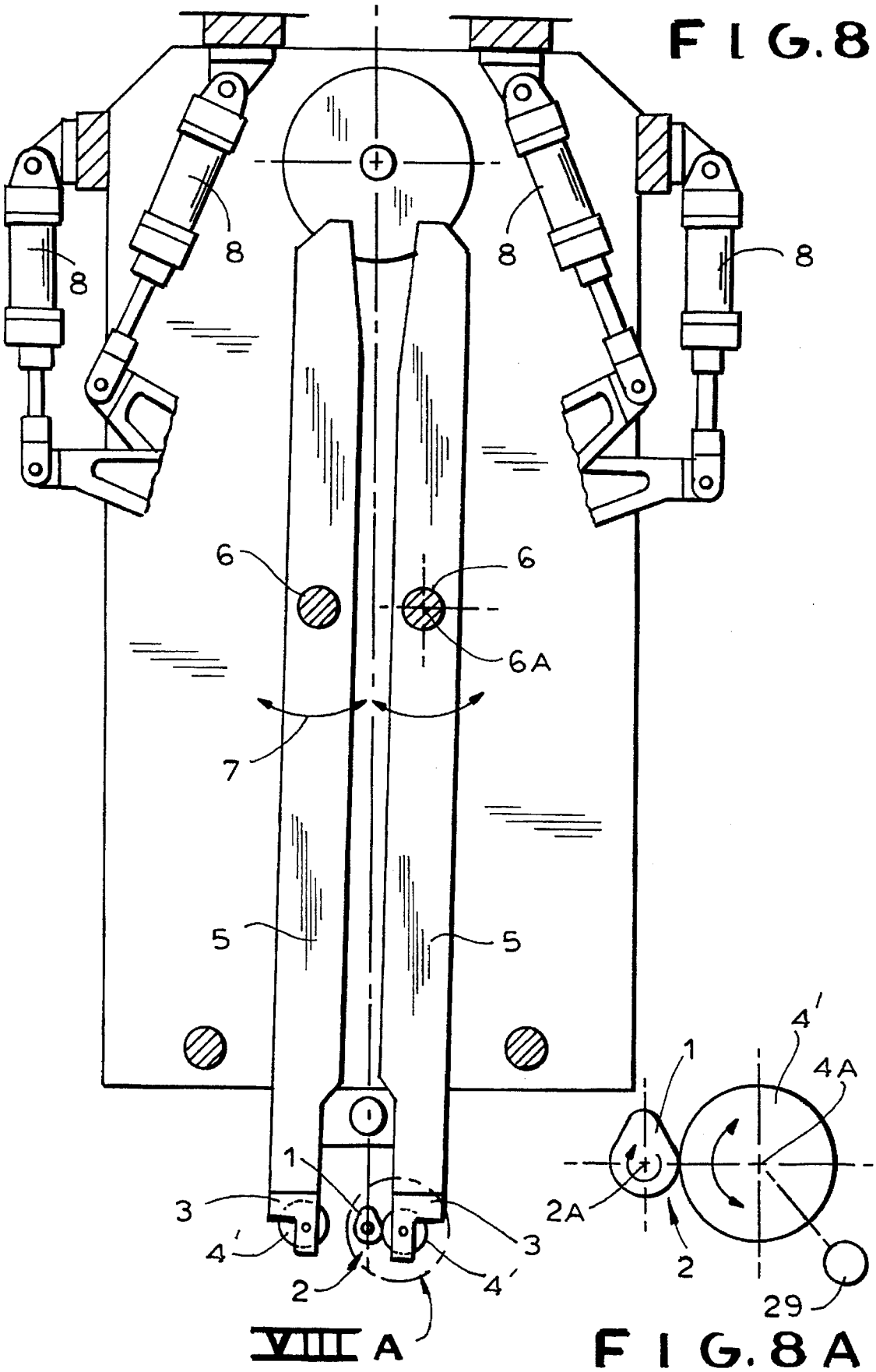

FIGS. 8 and 8A show how cylindrical stones 4' can be used that are continuously rotated or oscillated about respective axes 4A by i drive such as indicated schematically at 29. The axes 6A of shafts 6 cannot move relative to the camshaft axis 2A here.

arrangement of FIG. 9 and 9A uses stones 4 that are individually rocked back and forth about their axes 4A by respective drives such as shown schematically at 30.

We claim:

1. A method of honing an outer surface of a cam on a camshaft extending along a camshaft axis, the method comprising the steps of:

a) continuously rotating the camshaft about its axis at a predetermined rate;

b) holding each of a pair of grinding stones adjacent a respective side of the cam with a surface of each stone directed at the cam surface;

c) restricting movement of the grinding stones to displacement in two directions, one direction extending substantially perpendicular to a plane including the camshaft axis and the other direction extending generally parallel to the plane by mounting the stones on ends of respective arms having other ends pivoted on a rocker element pivotal about a rocker axis parallel to the camshaft axis with the other ends symmetrically flanking the rocker axis;

d) urging the grinding stones in the one direction against the cam and thereby pressing stone surfaces against the cam surface and thereby contacting each stone surface with the cam surface along a respective contact line, whereby the stones move in the one direction as the camshaft rotates; and e) continuously reciprocating the stone surfaces in the other direction by rocking the rocker element about the rocker axis, thereby continuously moving the contact lines between the cam surface and stone surfaces.

2. The honing method defined in claim 1 wherein the cam surface includes a part-cylindrical base region coaxial with the camshaft and a lobe region projecting radially outward from and joined to the base region, the stone surfaces being continuously reciprocated while engaging both of the regions.

3. The honing method defined in claim 2 wherein the base region has a predetermined radius and the stone surfaces are reciprocated in step e) through a stroke having a length generally equal to the radius.

4. The honing method defined in claim 1 wherein the camshaft is rotated at a rate and the stone surfaces are reciprocated in step e) at a rate not equal to a whole-number multiple of the rate at which the shaft is rotated.

5. The honing method defined in claim 1 wherein in step d) the stones are urged oppositely diametrically against the cam.

6. The honing method defined in claim 5 wherein in step e) the stone surfaces are reciprocated vertically oppositely to each other.

7. The honing method defined in claim 1 wherein in step e) the stone surfaces are reciprocated vertically oppositely to each other.

* * * * *